US009631908B2

(12) United States Patent
Park

(10) Patent No.: US 9,631,908 B2
(45) Date of Patent: Apr. 25, 2017

(54) ARROW

(71) Applicant: WIN&WIN Co. Ltd., Anseong-si (KR)

(72) Inventor: Dong Woon Park, Seoul (KR)

(73) Assignee: WIN&WIN CO. LTD., Gyeonggi-Do (KR)

( * ) Notice: Subject to any disclaimer, the term of this patent is extended or adjusted under 35 U.S.C. 154(b) by 0 days.

(21) Appl. No.: 14/611,508

(22) Filed: Feb. 24, 2015

(65) Prior Publication Data

US 2016/0245627 A1 Aug. 25, 2016

(51) Int. Cl.
*F42B 6/04* (2006.01)

(52) U.S. Cl.
CPC ..... *F42B 6/04* (2013.01)

(58) Field of Classification Search
CPC ..... F42B 6/04
See application file for complete search history.

(56) References Cited

U.S. PATENT DOCUMENTS

| | | | | |
|---|---|---|---|---|
| 2,288,562 | A * | 6/1942 | Birkhofer | F42B 6/04 473/586 |
| 6,017,284 | A | 1/2000 | Giles | |
| 6,179,736 | B1 | 1/2001 | Thurber | |
| 6,883,552 | B2 * | 4/2005 | Ooyauchi | B21C 37/06 138/177 |
| 8,388,473 | B2 * | 3/2013 | Smith | F42B 6/04 473/578 |

FOREIGN PATENT DOCUMENTS

KR 1020110021793 3/2011

* cited by examiner

*Primary Examiner* — John Ricci
(74) *Attorney, Agent, or Firm* — Cantor Colburn LLP

(57) ABSTRACT

Provided is an arrow, wherein by forming a diameter of a shaft, at a fore end of which a point is combined and at a rear end of which a nock is combined, in such a way that the diameter is reduced going from the fore end to the rear end, a center of weight is shifted toward the fore end so as to increase a hitting ratio of the arrow and a deflection deformation is reduced.

12 Claims, 3 Drawing Sheets

ARROW

BACKGROUND

Field of the Invention

The present invention relates to an arrow, and more particularly to an arrow having an improved function.

Background Art

In general, when an arrow is fired by a bow, it is instantaneously subject to a strong propelling force by a string.

At this time, since the string is acted upon by an inertia force which intends to keep a standstill condition at a present position, in general, when the arrow is fired by the bow, it is instantaneously subject to the strong propelling force by the string.

At this time, since the string is acted upon by the inertia force which intends to keep the standstill condition at the present position, the inertia force and the propelling force act on the arrow.

Since the inertia force acts on the entire arrow and the propelling force acts on a rear end of the arrow and is transmitted to a fore end thereof, a deflection deformation is generated at a middle of the arrow.

The magnitude of the deflection deformation varies with an elastic force of the bow and a length by which the string is drawn. If a strength of the bow is large or the length by which the bow is drawn is large, the arrow is deflected large, and if a strength of the bow is weak or the length by which the bow is drawn is small, the arrow is deflected small, and the deflection is a very important factor in firing of the arrow.

That is, the stronger the bow and the longer the length by which the bow is drawn, the strength of the middle portion of the arrow must be large.

In consideration of this, conventionally about 12 to 14 kinds of size of the arrow are manufactured by forming a fore end portion and a rear end portion of the arrow to have a constant thickness and forming a diameter of a middle portion to be large.

However, in case where the diameter of the middle portion of the arrow is large, a center of weight is positioned at the middle portion of the arrow, and accordingly there occurs a problem in that athletes requiring a high degree of accuracy must use an expensive tungsten point of high specific gravity to further shift the center of weight forward.

Furthermore, if the arrow is cut to suit the length of arms of a user, there occurs a problem in that it is impossible to adjust the degree of the deflection of the arrow as much as required.

In the two cases described above, there is a disadvantage in that since the thickness and the outer diameter become diverse according to the kinds of the arrow, a nock and the point have to be selected among 12 to 14 kinds accordingly. In case where the length of the middle portion of the arrow is increased, the arrow has a taper shape in which the diameter is gradually decreased going toward the fore end portion and the rear end portion from the middle portion.

In this case, when a part of the fore end portion or the rear end portion of the arrow is cut to adjust the length of the arrow, there occurs a problem in that the position of the end of the fore end portion or the rear end portion before the cutting comes close to the middle portion of the arrow, whereby the diameter is increased so that the point or the nock which could be combined before the cutting may not be combined.

SUMMARY OF THE INVENTION

An object of the present invention is to provide an arrow which may be used with a particular point and nock and which is easy to adjust the deflection, by forming a shape of a shaft in such a way that the center of weight is shifted toward the point and it is easy to adjust the deflection to suit the strength of the bow or the length by which the string is drawn.

An aspect of the present invention is directed to an arrow, wherein by forming a diameter of a shaft 110, at a fore end of which a point 120 is combined and at a rear end of which a nock 140 is combined, in such a way that the diameter is reduced going from the fore end to the rear end, a center of weight is shifted toward the fore end and a deflection deformation is decreased.

According to an embodiment of the present invention, the shaft 110 is divided into three portions, a shaft fore end portion a is a portion combined with the point 120, a shaft middle portion b is extended from the shaft fore end portion a, and has a diameter gradually decreasing from that of the shaft fore end portion a, and a shaft rear end portion c is extended from the shaft middle portion b and has a constant diameter identical to that of a rear end of the shaft middle portion b.

According to another embodiment of the present invention, a length of the shaft fore end portion a is adjustable and an outer diameter of the shaft fore end portion a is identical before and after the adjustment of the length.

According to another embodiment of the present invention, a length of the shaft rear end portion c is adjustable and an outer diameter of the shaft rear end portion c is identical before and after the adjustment of the length.

BRIEF DESCRIPTION OF THE DRAWINGS

The above and other aspects, features and advantages of certain exemplary embodiments of the present invention will be more apparent from the following description taken in conjunction with the accompanying drawings, in which.

Figure 1:
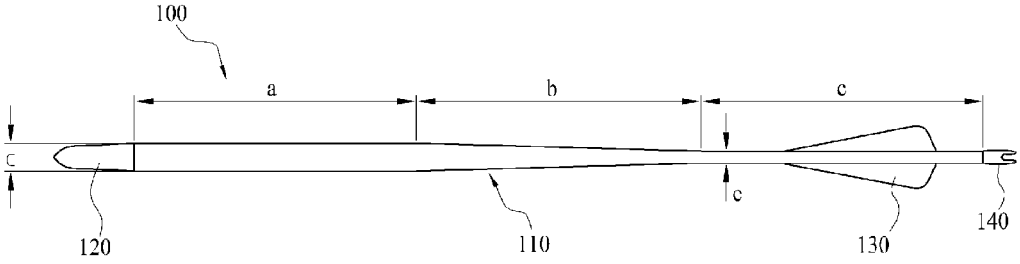
FIG. 1 is a side view showing an arrow of an embodiment of the present invention.

It should be understood that the appended drawings are not necessarily to scale, presenting a somewhat simplified representation of various preferred behaviors illustrative of the basic principles of the invention. The specific design behaviors of the present invention as disclosed herein, including, for example, specific dimensions, orientations, locations, and shapes will be determined in part by the particular intended application and use environment.

In the figures, reference numbers refer to the same or equivalent parts of the present invention throughout the several figures of the drawing.

DETAILED DESCRIPTION OF THE INVENTION

Exemplary embodiments of the present invention will be described below in detail with reference to the accompanying drawings. Wherever possible, the same reference numerals will be used to refer to the same elements throughout the specification, and a duplicated description thereof will be omitted. It will be understood that although the terms first, second, etc. are used herein to describe various elements, these elements should not be limited by these terms. These terms are only used to distinguish one element from another element.

The accompanying drawings are only for better illustration of the contents of the present invention, and it will be understood by those skilled in the art that the scope of the present invention is not defined by the scope of the accompanying drawings.

In addition, the terminology used in the present application is only for explanation of specific embodiment, and is not intended to define the present invention. As far as the expression of the singular number does not obviously otherwise mean in the context, it includes the expression of a plurality. In the present invention, the terminology such as "include" or "have" is to be understood to include an aspect, figure, step, action, constituent, part, or their combination, but not in advance exclude the existence of one or more other aspect, figure, step, action, constituent, part, or their combination.

Figure 2:
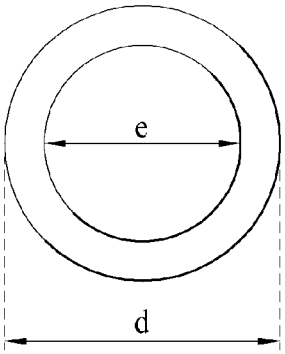
FIG. 2 is a sectional drawing of a part of FIG. 1.

FIG. 1 is a side view showing an arrow of an embodiment of the present invention, and FIG. 2 is a sectional drawing of a part of FIG. 1.

The arrow 100 of the embodiment of the present invention comprises a shaft 110 forming a body, formed with a portion changing in a diameter, and having a cylindrical section, a point 120 inserted into a fore end of the shaft 110, a fletching 130 formed at a rear end portion of the shaft 110 for keeping a direction of the arrow 100 at a flight of the arrow 100, and a nock 140 formed at a rear end of the shaft 110 for hooking a string.

The shaft 110 is divided into three portions, a shaft fore end portion a being a first portion is a portion combined with the point 120, a shaft middle portion b being a second portion is extended from the shaft fore end portion a, has a diameter gradually decreasing from that of the shaft fore end portion a, and has an outer inclined perimeter, and a shaft rear end portion c being a third portion is extended from the shaft middle portion b and has a constant diameter identical to that of a rear end of the shaft middle portion b.

The diameter e of the shaft rear end portion c is 4.5 mm same as a conventional one, the diameter d of the shaft fore end portion a is 5.5 mm, and the diameter of the shaft middle portion b is gradually decreased from 5.5 mm to 4.5 mm.

In the embodiment of the present invention, through a shape of shaft 110, a weight of the arrow 100 is heavy at the shaft fore end portion a compared to that at the shaft middle portion b or the shaft rear end portion c, whereby a center of weight of the arrow 100 is moved toward the shaft fore end portion a.

In addition, the diameter of the shaft middle portion b is gradually decreased from a point neighboring the shaft fore end portion a where the diameter is formed larger than a conventional one to a point neighboring the shaft rear end portion c where the diameter is formed same as the conventional one.

Since a deflection deformation for an identical material is generated easily in a case where the diameter is small compared to the length, at the shaft middle portion b occurs an effect that the generation of the deflection deformation is decreased.

An action of decreasing the generation of the deflection deformation is explained as follows;

When a user draws a bow and release it, as a string of the bow is generated a restoring force to restore the string from a tensioned condition, thereby pushing strongly the arrow forward.

At this time, in a conventional arrow, at the middle portion of the shaft where an inertia force to keep a standstill condition acts, the deflection deformation is generated by a propelling force transmitted instantaneously from the rear, and the deflection deformation is transmitted toward the fore end and the fore end of the shaft is shaken and fired forward.

In the conventional arrow, since the diameter is kept identical at the fore and the rear of the shaft, when the shake due to the deflection deformation is transmitted toward the fore end of the shaft from the rear end of the shaft, an amount of the decrease of the deflection deformation is small.

Therefore, there is a problem in that while the arrow flies it shakes strongly and decreases a hitting ratio.

However, in the arrow of the embodiment of the present invention, since the diameter is formed to be increased going from the rear end of the shaft toward the middle portion and the fore end, a strong force transmitted from the rear end at the time of firing of the arrow is transmitted in such a way that the deflection deformation is decreased in proportion to the increase of the diameter at the shaft middle portion b and is further greatly decreased at the shaft fore end portion a where the diameter is largest.

In addition, due to the entire shape of the shaft, an effect occurs that the center of weight of the bow is moved to the shaft fore end portion a so that an impact on a progress path of the entire bow due to the deflection deformation of the shaft middle portion b or the shaft rear end portion c is reduced.

Therefore, in the arrow of the present invention, an effect occurs that the hitting ratio is increased in comparison to the conventional arrow, and as a result, the reliability of a product is improved.

To increase the weight of the shaft fore end portion a, it is possible to use a tungsten or a stainless steel as a material of the point 120 combined to the shaft fore end portion a.

In this case, the increase in the weight due to the material of the point 120 is added to the increase in the weight due to the increase in the diameter of the shaft fore end portion a, thereby the decrease in the deflection deformation becomes further remarkable.

In addition, there is an effect that since the shaft rear end portion c has the same diameter as the conventional arrow, a conventional nock 140 may be used so as to keep compatibility.

Meanwhile, the present invention has a structure in which the length of the shaft fore end portion a being the first portion and the length of the shaft rear end portion c being the third portion may be varied.

That is, either both or one of the length of the shaft fore end portion a and the length of the shaft rear end portion c may be decreased according to a condition of the body of the user of the bow.

Figure 3:
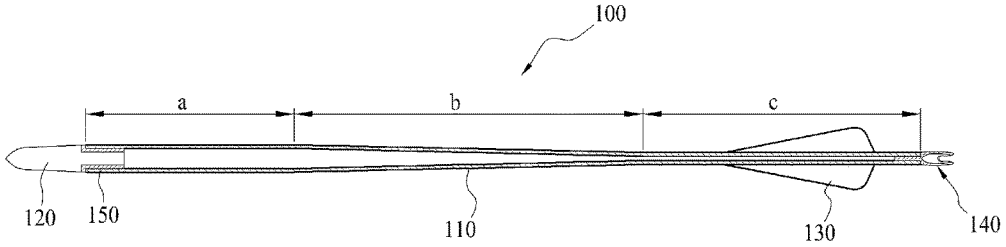
FIG. 3 is a schematic side sectional drawing showing an arrow.

FIG. 3 is a schematic side sectional drawing showing the arrow.

Reviewing the side sectional drawing of the arrow 100 of an embodiment of the present invention, the shaft 110 is as a whole formed in a hollow form.

The point 120 is the one conventionally used and combined to the shaft 110 having a conventional entirely constant diameter, and at a point screw portion 122 formed at a rear of the point 120, an outer diameter smaller than an inner diameter of the shaft fore end portion a of the present invention is formed.

Therefore, in the embodiment of the present invention, a separating space is formed between the point 120 and the inside of the shaft fore end portion a, and a shaft insert 150 is formed in the separating space.

In the embodiment of the present invention, there occurs an effect that since the conventionally used point 120 may be applied to the embodiment of the present invention due to the shaft insert 150, the compatibility of the product is improved.

In addition, since the fore end portion of the arrow becomes heavier as much as the weight of the shaft insert 150, there occurs an effect that the center of the weight may be shifted toward the fore end portion of the arrow.

Figure 4:
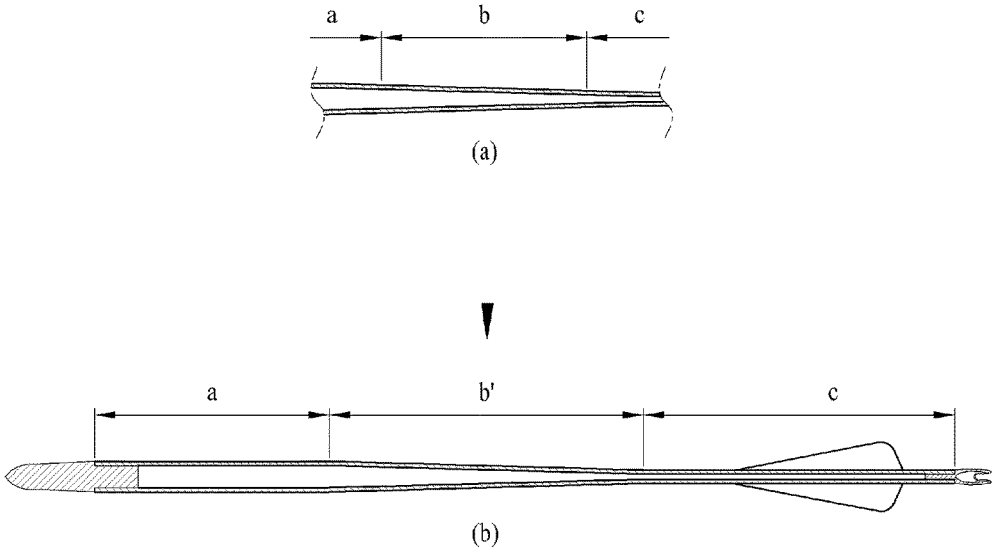
FIG. 4 is a schematic drawing illustrating a procedure of adjusting a length of a middle portion of an arrow of the embodiment of the present invention.

FIG. 4 is a schematic drawing illustrating a procedure of adjusting a length of a middle portion of an arrow of the embodiment of the present invention.

In the embodiment of the present invention, in the manufacturing procedure of the arrow, it is possible to manufacture by making the length of the shaft fore end portion a and the length of the shaft rear end portion c identical, and only increasing the length of the shaft middle portion from b to b'.

Figure 5:
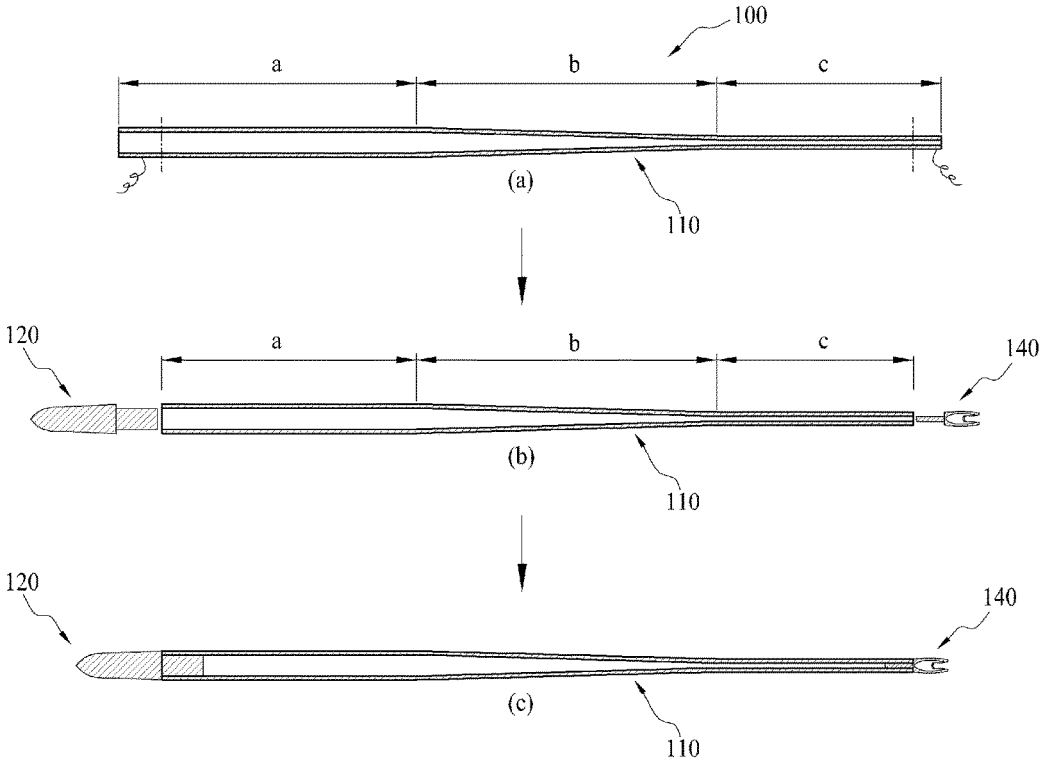
FIG. 5 is a schematic drawing illustrating a procedure of adjusting a length of an arrow of the embodiment of the present invention.

FIG. 5 is a schematic drawing illustrating a procedure of adjusting a length of the arrow of the embodiment of the present invention.

Recently, there are a variety of users of the bow due to an increase of the leisure population, and the users want to vary the shape and the length of the arrow 100 according to their own body condition and the use of the bow, and as such, the arrow 100 only becomes an accurate custom-made arrow.

The embodiment of the present invention provides the arrow 100 which may vary the shape or the length of the arrow 100 to suit the body condition of the users or the use of the bow.

The variation of the shape of the arrow 100 through the embodiment of the present invention is due to the fact that the shaft 110 of the arrow 100 has a form in which breadth of the shaft fore end portion a and the shaft rear end portion c are different with the shaft middle portion b as a reference.

When the user wants to reduce the length of the arrow 100, in case of cutting out a part of the shaft fore end portion a, the arrow 100 is resulted which has a form in which the shaft rear end portion c is relatively longer than the shaft fore end portion a with the shaft middle portion b as a reference, and in case of cutting out a part of the shaft rear end portion c, the arrow 100 is resulted which has a form in which the shaft fore end portion a is relatively longer than the shaft rear end portion c with the shaft middle portion b as a reference.

In addition, in case of cutting out both a part of the shaft fore end portion a and a part of the shaft rear end portion c by a same amount, the entire length of the arrow 100 is reduced and the length of the shaft fore end portion a and the shaft rear end portion c become same with the shaft middle portion b as a reference.

FIG. 5(*a*) is a sectional view showing a condition where the user cuts a part at each of the shaft fore end portion a and the shaft rear end portion c of the arrow 100.

An operation of cutting the shaft fore end portion a and the shaft rear end portion c of the arrow 100 may be completed through a procedure of gradually suiting the length and shape to the user himself while the user uses the arrow 100.

Through this procedure, in the arrow 100 in which a part of each of the shaft fore end portion a and the shaft rear end portion c is cut out, the point 120 is combined to the fore end and the nock 140 is combined to the rear end.

In the embodiment of the present invention, as shown in FIG. 5(*b*), the inner diameter of the fore end and the rear end of the cut arrow 100 are same as those in the condition of before cutting.

Therefore, the user may combine the point 120 and the nock 140, which were combined prior to the cutting of the arrow 100, to the shaft 110 as they are, as shown in FIG. 5(*c*).

The arrow of the embodiment of the present invention has an effect that the weight is concentrated on the shaft fore end portion through the shape of the shaft, and in the shaft middle portion, the generation of the deflection deformation is reduced due to the form in which the diameter is gradually reduced from a large one.

Therefore, in the arrow of the embodiment of the present invention, the center of weight is shifted forward compared to the conventional arrow so that the hitting ratio is improved and each of the nock and the point requires only one in number.

In addition, when the user cuts the arrow to adjust the length of the arrow, an extent of the deflection may be adjusted by adjusting the part of the cutting of the arrow to suit a strength of his arrow and a length of drawing.

As a result, the embodiment of the present invention has an effect that since the center of weight may be shifted forward and the part of the cutting of the arrow may be adjusted, the reliability of the product is improved.

In the arrow of the embodiment of the present invention, there occurs an effect that the weight of the arrow is concentrated to the shaft fore end portion through the shape of the shaft so that the accuracy is improved.

In addition, since the diameter of the shaft middle portion is gradually decreased from the large one and the diameter of the shaft fore end portion and the shaft rear end portion is constant, even in the case where parts of one or both of the shaft fore end portion and the shaft rear end portion are adjusted, one kind of nock and point which were previously used may be still used.

Furthermore, in the embodiment of the present invention, since the shaft fore end portion and the shaft rear end portion may be cut in an appropriate relation of them at the time of cutting the arrow to suit the length of arms of the user, so that the required deflection strength may be obtained.

While the invention has been shown and described with reference to exemplary embodiments thereof, it will be understood by those skilled in the art that various changes in form and details may be made therein without departing from the spirit and scope of the invention as defined by the appended claims. Therefore, the scope of the invention is defined not by the detailed description of the invention but by the appended claims, and all differences within the scope will be construed as being included in the present invention.

| Explanation of Reference Characters | |
|---|---|
| 100: Arrow | 110: Shaft |
| 120: Point | 130: Fletching |
| 140: Nock | a: Shaft fore end portion |
| b: Shaft middle portion | c: Shaft rear end portion |

What is claimed is:

1. An arrow comprising:

a shaft fore end portion having a first outer diameter;

a point inserted into a front end portion of the shaft fore end portion;

a shaft middle portion extended from a rear end of the shaft fore end portion, the shaft middle portion having a second outer diameter;

a shaft rear end portion extended from a rear end of the shaft middle portion, the shaft rear end portion having a third outer diameter; and a nock inserted into a rear end portion of the shaft rear end portion, wherein the first outer diameter is constant over entire length of the shaft fore end portion, and the third outer diameter is constant over entire length of the shaft rear end portion, wherein the first outer diameter is larger than the third outer diameter, wherein the second outer diameter is gradually smaller from the first outer diameter at a front end of the shaft middle portion toward the third outer diameter at the rear end of the shaft middle portion, and wherein the shaft middle portion has a length substantially same as that of the shaft fore end portion or the shaft rear end portion.

2. The arrow of claim 1, wherein the length of the shaft fore end portion is adjustable.

3. The arrow of claim 1, wherein the length of the shaft rear end portion is adjustable.

4. The arrow of claim 1, wherein the shaft middle portion is extended directly from the rear end of the shaft fore end portion.

5. The arrow of claim 1, wherein the shaft rear end portion is extended directly from the rear end of the shaft middle portion.

6. The arrow of claim 1, wherein the shaft fore end portion, the shaft middle portion and the shaft rear end portion have a cylindrical hollow shape.

7. The arrow of claim 1, wherein the shaft fore end portion, the shaft middle portion and the shaft rear end portion have a hollow cylindrical shape and form a single integral body.

8. The arrow of claim 1, wherein the first outer diameter is 5.5 mm and the third outer diameter is 4.5 mm.

9. An arrow comprising:

a shaft fore end portion having a first outer diameter;

a point inserted into a front end portion of the shaft fore end portion;

a shaft middle portion extended from a rear end of the shaft fore end portion, the shaft middle portion having a second outer diameter;

a shaft rear end portion extended from a rear end of the shaft middle portion, the shaft rear end portion having a third outer diameter; and a nock inserted into a rear end portion of the shaft rear end portion, wherein the first outer diameter is constant over entire length of the shaft fore end portion, and the third outer diameter is constant over entire length of the shaft rear end portion, wherein the first outer diameter is larger than the third outer diameter, wherein the second outer diameter is gradually smaller from the first outer diameter at a front end of the shaft middle portion toward the third outer diameter at the rear end of the shaft middle portion, and wherein the shaft fore end portion, the shaft middle portion and the shaft rear end portion have a hollow cylindrical shape and form a single integral body, wherein the shaft middle portion has a length substantially same as or larger than that of the shaft fore end portion or the shaft rear end portion.

10. The arrow of claim 9, wherein the shaft middle portion is extended directly from the rear end of the shaft fore end portion.

11. The arrow of claim 9, wherein the shaft rear end portion is extended directly from the rear end of the shaft middle portion.

12. The arrow of claim 9, wherein the first outer diameter is 5.5 mm and the third outer diameter is 4.5 mm.

* * * * *